US006837089B2

(12) United States Patent
Jentzsch

(10) Patent No.: US 6,837,089 B2
(45) Date of Patent: Jan. 4, 2005

(54) METHOD AND APPARATUS FOR REFORMING AND REPROFILING A BOTTOM PORTION OF A CONTAINER

(75) Inventor: K. Reed Jentzsch, Arvada, CO (US)

(73) Assignee: Ball Corporation, Broomfield, CO (US)

( * ) Notice: Subject to any disclaimer, the term of this patent is extended or adjusted under 35 U.S.C. 154(b) by 27 days.

(21) Appl. No.: 10/408,043

(22) Filed: Apr. 3, 2003

(65) Prior Publication Data

US 2004/0194524 A1 Oct. 7, 2004

(51) Int. Cl.[7] ..... B21D 3/02

(52) U.S. Cl. ..... 72/117; 72/110; 72/120; 72/123; 72/379.4

(58) Field of Search ..... 72/94, 117, 118, 72/120, 122, 123, 125, 126, 379.4; 413/69

(56) References Cited

U.S. PATENT DOCUMENTS

| | | | | |
|---|---|---|---|---|
| 4,435,969 A | | 3/1984 | Nichols et al. | 72/126 |
| 4,563,887 A | | 1/1986 | Bressan et al. | 72/84 |
| 4,781,047 A | | 11/1988 | Bressan et al. | 72/84 |
| 4,885,924 A | | 12/1989 | Claydon et al. | 72/109 |
| 5,222,385 A | | 6/1993 | Halasz et al. | 72/117 |
| 5,245,848 A | | 9/1993 | Lee, Jr. et al. | 72/84 |
| 5,540,352 A | | 7/1996 | Halasz et al. | 220/606 |
| 5,697,242 A | * | 12/1997 | Halasz et al. | 72/117 |
| 5,706,686 A | * | 1/1998 | Babbitt et al. | 72/117 |
| 5,934,127 A | | 8/1999 | Ihly | 72/110 |
| 6,055,836 A | * | 5/2000 | Waterworth et al. | 72/110 |
| 6,058,753 A | * | 5/2000 | Jowitt et al. | 72/91 |
| 6,616,393 B1 | * | 9/2003 | Jentzsch | 413/67 |
| 2003/0177803 A1 | * | 9/2003 | Golding et al. | 72/94 |

* cited by examiner

*Primary Examiner*—Ed Tolan
(74) *Attorney, Agent, or Firm*—Sheridan Ross P.C.

(57) ABSTRACT

A reforming assembly for simultaneously reforming and reprofiling a bottom portion of a metallic container is provided. The reforming assembly generally includes a roller block having a pair of reform rollers and two pairs of outside reprofile rollers. A biasing means is operably interconnected to the reform rollers, such that the reform rollers extend to contact the inner surface of the bottom portion of the container when contacted by the bottom portion of the container. The outside reprofile rollers engage with an outer surface of the bottom portion of the container. The container reforming assembly is rotated, while maintaining the container body in a static non-rotating position, to create an internal can profile on the inner surface by the pair of reform rollers, and an external can profile on the outer surface by the outside reprofile rollers.

31 Claims, 13 Drawing Sheets

METHOD AND APPARATUS FOR REFORMING AND REPROFILING A BOTTOM PORTION OF A CONTAINER

FIELD OF THE INVENTION

The invention relates generally to the manufacture of containers, and, more particularly, to a method and apparatus for simultaneously reforming and reprofiling the bottom portion of a metal container to enhance strength characteristics.

BACKGROUND OF THE INVENTION

A typical approach to manufacturing beverage or other containers (such as, commonly, 12 ounce to 32 ounce pop or beer containers), involves a two piece construction procedure involving forming a body piece which contains a (typically cylindrical) sidewall and a bottom, all formed from a single piece of metal, typically aluminum, and a second top or cover piece joined to the neck of the body piece, e.g. by a double seaming or curling operation. An important consideration in designing and fabricating such containers involves providing a desirable balance between minimizing material requirements (such as providing relatively thin-gauge metal) while achieving a container that will maintain its integrity and/or form, despite shipping and handling impacts or forces and impact arising from dropped containers and shipping mishaps. Moreover, it is critical to provide containers which maintain integrity and/or form even when contents are under pressure due to carbonated or otherwise gas-pressured contents and/or arising from high internal temperatures, including, in some cases, pasteurization temperatures.

Typical beverage container forming processes include subjecting a thin sheet of metal alloy to a series of drawing, ironing, and/or forming operations. One of the first steps performed on such a metal sheet is a cupping process where the sheet is drawn into a seamless cup to establish an initial shape and inside diameter of the container. Subsequently, the cup is pushed through a series of ironing rings to thin the outer wall of the container to a selected thickness. During these ironing processes, performed with equipment commonly referred to as bodymaker tooling, the diameter of the container is typically maintained while the outer wall length is substantially increased to establish the fluid capacity of the container. The bottom portion of the container is generally formed to define a recessed or concave dome surface to resist deformation due to internal fluid pressures. The pressure at which the recessed surface is deformed or reversed is often called the "static dome reversal pressure" of the container. The bottom portion of the container also includes an annular support member which will contact a supporting surface to maintain the container in a vertical position during stacking, consumer use, and the like.

As mentioned above, reduction in raw material required to manufacture such a container is highly desirable. One successful method known in the art for reducing raw material usage has been to reduce the diameter of the top and bottom portions of the can, commonly known as "necking." By reducing the diameter of the top and bottom portions of the can, the material usage for the "lid" portion of the can is significantly reduced, and even a small reduction in this diameter can result in significant cost reductions for a container manufacturing operation. Two container diameter sizes for soda and beer containers are 2 5/16 inches and 2 4/16 inches, which are commonly known as 202 and 204 containers, respectively. Numerous other diameter sizes exist, and are well known in the art. Many manufacturers produce 202 and 204 containers using the same bodymaker tooling, and perform different operations to obtain the appropriate sized end closure or "lid" portions.

Specifically, for the annular support member on the bottom portion, an additional step known as reprofiling is performed on a container which has a nominal 204 diameter to obtain a 202 sized container. The annular support member generally contains outer and inner surfaces that join the outer wall to the annular support member and that join the annular support member to the domed surface, respectively. These outer and inner surfaces have profiles which are shaped during the manufacture of the container, to provide an outside dome profile, and an inside dome profile. The configuration of the bottom portion is important in facilitating material usage reductions, since various geometric configurations can be utilized to enhance strength characteristics. For example, the bottom portion may be configured to enhance the static dome reversal pressure characteristics and to reduce the risk of damage caused when a filled container is dropped onto a hard surface during shipping storage and use. This drop resistance may be described as the cumulative drop height at which the bottom portion is damaged sufficiently to preclude the container from standing upright on a flat surface, or stacking on another container.

A process known as "reforming" has been widely used, in which the inside dome profile of the bottom portion of a container is formed to create a geometric configuration with improved strength characteristics. Reforming results in increased buckle and drop strength for beverage containers. The outside dome profile is also often configured, i.e., reprofiled for purposes of enhancing of the stacking capability of beverage containers and to improve the strength. Further, reform/reprofiling has also been proven to control "dome growth", a condition where a container gets taller after going through the pasteurizing process. As mentioned above, in order to have a manufacturing plant which is able to manufacture both 204 and 202 cans, the bottom portion of the can may be reprofiled which reworks the outside dome profile to a reduced diameter 202 beverage container from a 204 beverage container.

Typical can manufacturing facilities, as mentioned above, contain expensive capital equipment and often produce hundreds of millions of beverage containers per year. Accordingly, it is beneficial to have a facility which is able to produce both 202 and 204 beverage cans, in order to provide customers with both type of cans without requiring a separate manufacturing facility. Both 202 and 204 beverage cans can be produced with the same bodymaker tooling, resulting in the factory only requiring the selection of the post process reprofiling, or none, to achieve either a 202 or a 204 dome at the end of the process line.

Currently, when a factory wants to combine the two processes to produce a 202 beverage can with improved dome properties, it requires the use of two machines in tandem. First, a reforming tool is used to form the appropriate inside dome geometric profile required for various dome strength parameters as mentioned above. Following the reforming operation is a reprofiling operation, in which a reprofiling tool is used to form the outside dome profile required for a 202 beverage container.

As will be appreciated by one skilled in the art, an additional machine within the factory results in the requirement of an additional piece of expensive capital equipment, which must also be maintained at a significant yearly expense. Further, an additional piece of equipment occupies valuable floor space within the limited confined space of a manufacturing facility. Furthermore, typical reform equipment currently in use in a typical container manufacturing plant have inherent cost related to the wear of mechanisms and tooling, which can create performance issues if maintenance is not performed on a regular basis. It is highly desirable to reduce such maintenance, as performing the maintenance results in the machine being out of service for manufacturing use, and also requires personnel to service the machine and replacement parts, all of which add to the total cost of producing beverage containers.

One example of an attempt to solve the aforementioned problems is described in U.S. Pat. No. 5,934,127 to Ihle, ("the '127 patent"), which describes an apparatus for reforming the bottom portion of a container by utilizing a container rotating device to spin the container while reforming a bottom portion of the container. Unlike the invention described in the '127 patent, the present invention does not require the rotation of the container body, which is held in a static position while a reforming/reprofiling assembly rotates around the longitudinal axis of the container. This has numerous advantages, including a self-contained unit which needs no external cams, levers, or mechanisms to actuate the reprofiling tools or reforming tools. The unit is actuated by container movement into the tool, or tool movement into the container or both. The unit easily mounts to existing flanging/reforming/reprofiling/necking machines common in most container manufacturing facilities. Holding the container body in a static position is beneficial, as spinning containers are relatively difficult to convey out of a machine. Furthermore, the tooling of the present invention is easily set up and changed over from existing tooling for reforming and reprofiling containers, whereas the apparatus described in the '127 patent requires the purchase and installation of an entirely different machine.

Accordingly, a need exists for an apparatus and process which is capable of producing a metallic container which does not require a separate machine or separate process to both reform and reprofile an end portion of the container. Additionally, it would be beneficial to have a process which reduces overall maintenance in a manufacturing facility, and to reduce the inherent wear of machinery and the tooling associated therewith.

SUMMARY OF THE INVENTION

The present invention solves the aforementioned problems and meets other needs which are beneficial and cost effective in a container manufacturing facility. More specifically, the invention provides a method and apparatus for simultaneously reforming and reprofiling a bottom portion of a container.

In one aspect, the present invention provides an apparatus which includes a container reforming assembly having a roller block aligned in opposing relationship to the bottom portion of a container, the roller block having an outer annular edge and a leading surface. A rotating means rotates the container reforming assembly, while maintaining the container body in a static, non-rotating position. In one embodiment, two pairs of outside reprofile rollers extend outwardly from the leading surface of the roller block in a direction substantially parallel to a longitudinal axis of the container, and are positioned proximate to the outer annular edge of the roller block. A pair or reform rollers project outwardly from the roller block leading surface and are operable sized to receive the inner surface of the annular support member. A biasing means is operably interconnected to the pair of reform rollers, wherein when a force is applied to an annular flange on the pair of reform rollers by the bottom portion of the container, the reform rollers travel outwardly toward the outer annular edge of the roller block, wherein an internal can profile is created on the inner surface of the annular support member by the pair of reform rollers, and an external can profile is created on the outer surface of the annular support member by the two pairs of outside reprofile rollers.

In one embodiment, each of the reform rollers extend outwardly at least about 0.10 inches when a force is applied to the flanges on the pair of reform rollers. Depending on the type of container and preferred geometry of the container, this distance may be between 0.05 –0.1 inches. Each of the pair of reform rollers may be operably interconnected to a bushing which is oriented transversely to the longitudinal axis of the container. The biasing means may include at least one spring operably interconnected to at least one of the pair of reform rollers. The reform rollers may move in at least two distinct directions when force is applied to the flange on the pair of reform rollers. The container reforming assembly may further include a slider block which is operably positioned between the roller block and the mounting shaft.

It is another aspect of the present invention to provide an apparatus which can be selectively used to either reform an interior dome portion on a lower portion of a container, reprofile the exterior dome portion on a lower end of a container, or perform both operations simultaneously. More specifically, the pair of reform rollers may be selectively removed and the outside reprofile rollers can be used independently to reprofile the outer surface of the annular support member. The rotating means may include a shaft operably interconnected to a motor. A means for holding the container in a non-rotating, substantially stationary position is provided, and in one embodiment includes a mandrel which is inserted into the internal portion of the container to engage an interior surface of the container to prevent movement. Alternatively, and as appreciated by one skilled in the art, other types of mechanisms or apparatus may be provided which can retain a container in a static position without causing any type of deformation to the container body while a reforming/reprofiling operation is conducted on a lower portion of the container.

In another aspect of the present invention, an apparatus adapted for reforming a bottom portion of a container is provided. The apparatus includes a mandrel operably supporting the container in a substantially stationary position, a reforming assembly, a rotating means, and a biasing means. The reforming assembly includes a main roller block and at least two reprofile rollers extending outwardly from the main roller block in a direction substantially parallel to the longitudinal axis of the container and positioned in opposing alignment to the bottom portion of the container. The rotating means is operably interconnected to the reforming assembly to rotate the reforming assembly around the longitudinal axis of the container. The biasing means is operably interconnected to the reform rollers, such that when a downward pressure is applied to an annular flange of the reform rollers, at least one of the reform rollers moves in an outward direction toward an annular edge of the main roller block to engage an inner surface on an annular bottom portion of the container, and a preferred geometric profile of the container bottom portion is formed.

In one embodiment of the present invention, a preferred geometric profile of an outer surface of the annular bottom portion of the container is formed from the reprofile rollers, while a preferred profile of an inner surface of the annular bottom portion of the container is formed from the reform rollers. Each of the reform rollers maybe operably interconnected to a bushing which is oriented transversely to the longitudinal axis of the container. The biasing means may comprise a leaf spring or other similar mechanism well known in the art. The roller block may also be operably interconnected to an adjustable slider block and a mounting shaft.

In another aspect of the present invention, a method is provided for simultaneously reforming and reprofiling a bottom portion of a metallic container. The method includes the steps of holding the container in a substantially stationary, static position, providing a reforming assembly, rotating the reforming assembly, and engaging an annular support member of the metallic container with the reforming assembly, wherein an inner surface of an annular support member is reformed and an outer surface of the annular support member is reprofiled substantially simultaneously. In general, the container includes side walls disposed about a substantially longitudinal axis, and the reforming assembly is rotated around the substantially longitudinal axis. The reforming assembly in one embodiment includes a roller block having an outer annular edge and a leading surface, the leading surface aligned in opposing relationship to the bottom portion of the container. The reforming assembly also includes two pairs of outside reprofile rollers which extend outwardly from the leading surface of the roller block, and a pair of reform rollers which project outwardly from the roller block leading surface which includes a flange sized to engage the annular support member of the bottom portion of the container. The reforming assembly further includes a biasing means in operable engagement with the pair of reform rollers, such that when a force is applied to the flange from the leading edge of the container neck, at least one of the reform rollers moves outwardly toward the annular edge. The annular support member engages with the reforming assembly such that when the annular support member is engaged with the flanges of the reform rollers, an inner surface of the annular support member is reformed while the outer surface of the annular support member is reprofiled substantially simultaneously.

In one embodiment of the present invention, the reform rollers move outwardly about 0.10 inches when force is applied to the flange, although this dimension may obviously be increased or decreased depending on the preformed geometric profile of the container. In one embodiment, the rotating step includes rotating the reforming assembly with a motor. In another embodiment, the holding step includes providing a support means such as a mandrel which engages at least an internal surface of the side walls of the container. In another embodiment, the reforming assembly may also include an adjustable slider plate operably positioned between the roller block and a mounting shaft. In another embodiment, the pair of reform rollers are operably interconnected to a bushing which is oriented transversely to the longitudinal axis of the container.

It is a further aspect of the present invention to provide an improved geometric profile on the lower end portion of a container to improve strength and to optimize material savings. Thus, in one embodiment of the present invention, a container is provided which has a geometric profile defined by a reformed area on the inner surface of the annular support member having a relatively pronounced "hook" shape. The "hook" of the reform groove substantially locks the dome, thus keeping the wall from unwinding and controlling dome growth to no greater than about 0.030 inches. The outer surface of the annular support member may also be reprofiled, further enhancing strength and optimizing material savings.

In another aspect of the present invention, an apparatus is provided for reforming an end portion of a container subsequent to the end being interconnected to the container, the container having an outer wall disposed around a longitudinal axis. The apparatus preferably includes a mandrel operably supporting the container in a substantially stationary position, a reform assembly, a rotating means, and a biasing means. The reforming assembly includes a main roller block and at least two reform rollers and at least two reprofile rollers extending outwardly from the main roller block in a direction substantially parallel to the longitudinal axis of the container and positioned in opposing alignment to the bottom portion of the container. The rotating means is operably interconnected to the reforming assembly to rotate the reforming assembly around the longitudinal axis of the container. The biasing means is operably interconnected to the reform rollers, wherein when a downward pressure is applied to an annular flange of the reform rollers, at least one of the reform rollers moves in an outward direction toward the annular edge of the main roller block to engage an inner surface of an annular bottom portion of the container, wherein a preferred geometric profile of the container bottom is formed.

Thus, in one embodiment of the present invention, an apparatus is provided which is adapted for simultaneously reforming and reprofiling a bottom portion of a container, the container having a side wall disposed about a longitudinal axis, the bottom portion being interconnected to the side wall and having an annular support member with an inner surface and an outer surface, the apparatus comprising:

a means for holding said container, a container reforming assembly comprising a roller block aligned in opposing relationship to the bottom portion of the container, said roller block having an outer annular edge and a leading surface;

a rotating means for rotating said reform assembly;

two pairs of outside reprofile rollers which extend outwardly from said leading surface of said roller block and are positioned proximate to said outer annular edge;

a pair of reform rollers which project outwardly from said roller block leading surface and which are operably sized to receive the inner surface of the annular support member of the container; and a biasing means operably interconnected to said pair of reform rollers, wherein when a force is applied to an annular flange on said pair of reform rollers by the bottom portion of the container, said reform rollers extend outwardly toward said outer annular edge of said roller block, wherein an interior can profile is created on the inner surface of said annular support member by said pair of reform rollers, and an exterior can profile is created on the outer surface of said annular support member by said two pairs of outside reprofile rollers.

Additional features and other embodiments of the present invention will become apparent from the following discussion, particularly when taken together with the accompanying drawings.

DETAILED DESCRIPTION

Figure 1:
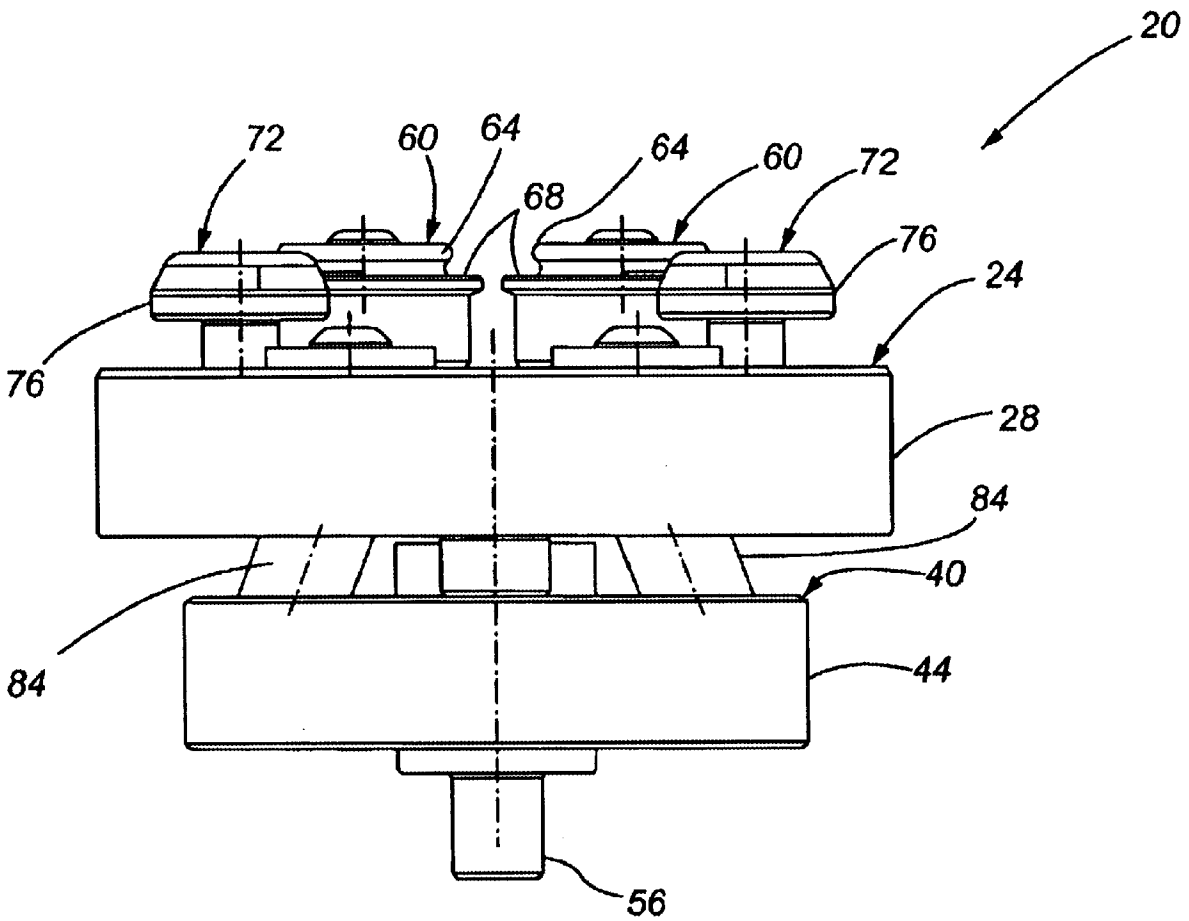
FIG. 1 is a front elevation view of a reform and reprofile apparatus of one embodiment of the present invention.

While this invention may have many embodiments in many different forms, there are shown in the drawings and will herein be described in detail, preferred embodiments of the invention with the understanding that the present disclosure is to be considered as an exemplification of the principles of the invention and is not intended to limit the broad aspects of the invention to the embodiments illustrated.

Referring now to the drawings, FIGS. 1-9 represent one embodiment of the present invention, wherein a reform and reprofile apparatus 20 is provided which is adapted for simultaneously reforming and reprofiling the bottom portion of a beverage container. As appreciated by one skilled in the art, the invention may be used for any type of metallic container and is not specifically limited to a beverage container such as a soft drink or beer can.

Figure 2:
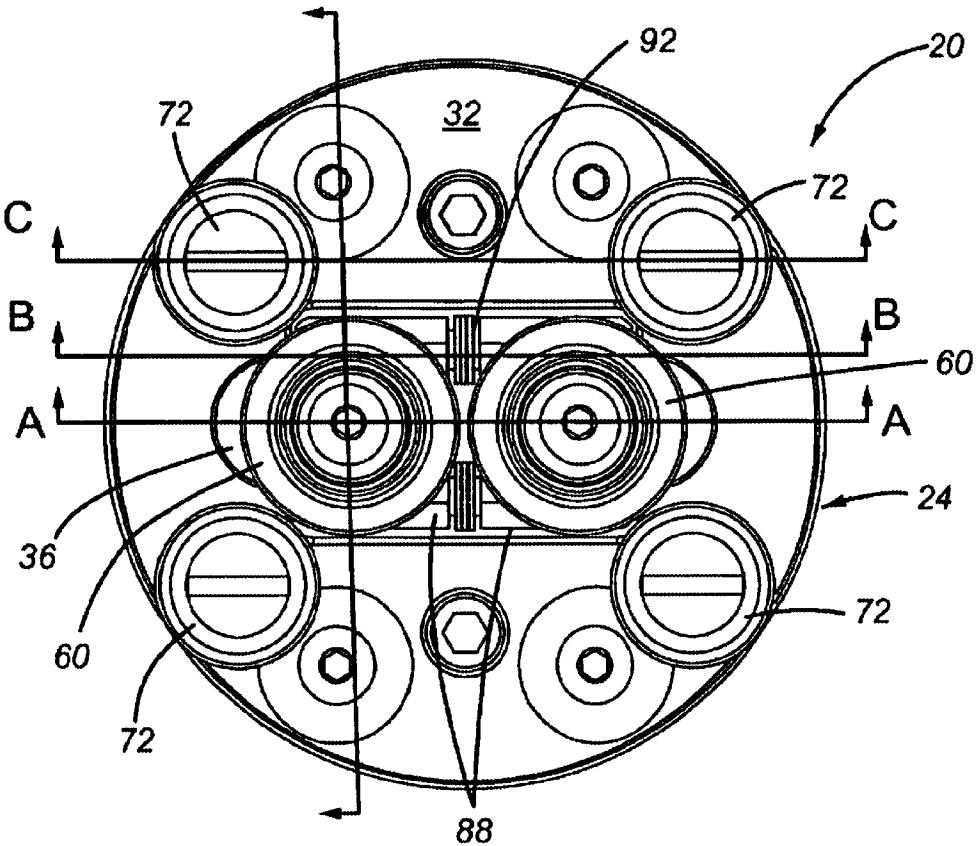
FIG. 2 is a top plan view of the reform and reprofile apparatus depicted in FIG. 1.
Figure 3:
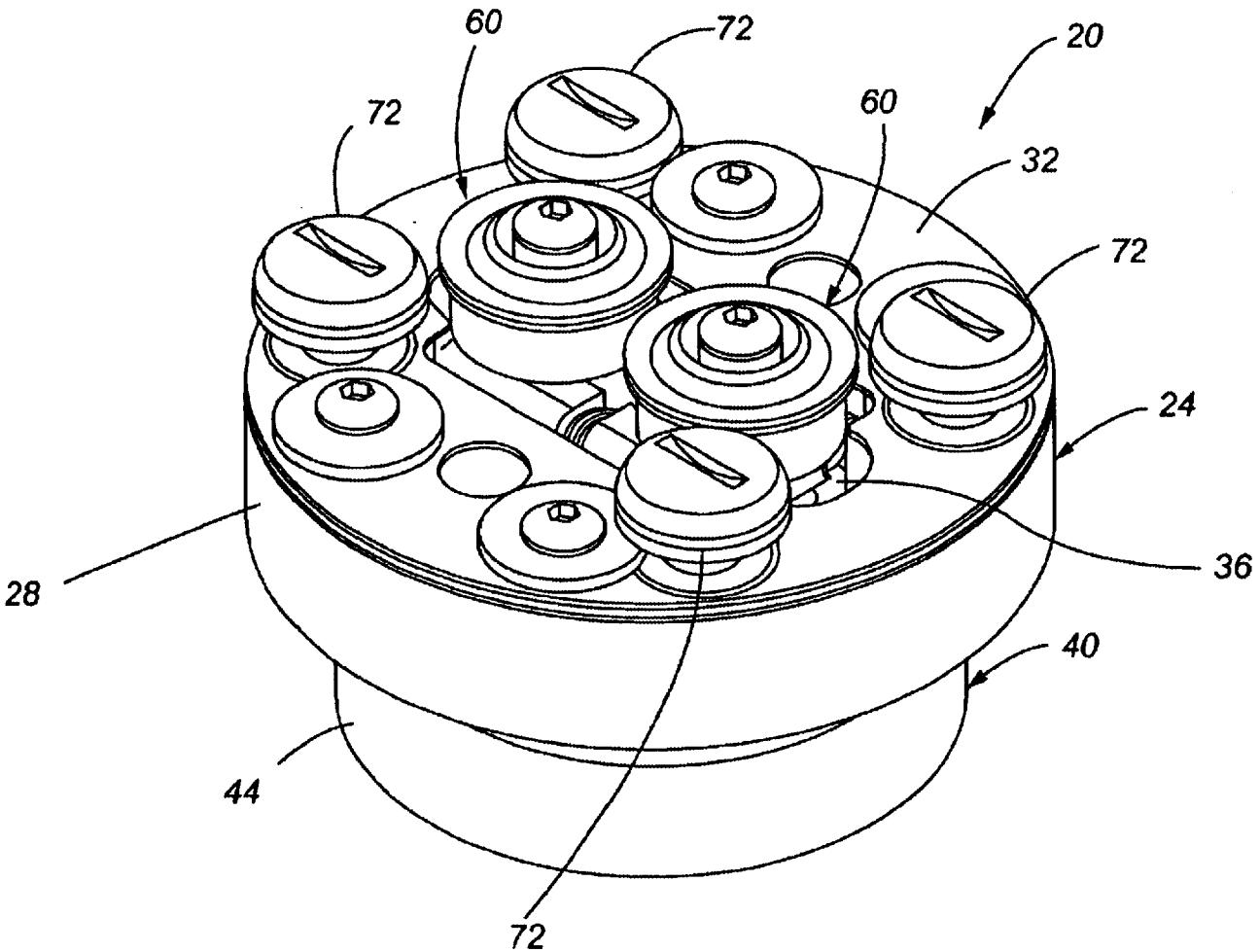
FIG. 3 is a front perspective view of the reform and reprofile apparatus of FIG. 1.

More specifically, FIGS. 1 and 2 are a front elevation view and a top plan view, respectively, and FIG. 3 is a top perspective view of the reform and reprofile apparatus 20 of the present invention. The reform and reprofile apparatus 20 generally includes a roller block 24 having a roller block outer annular edge 28, a roller block leading surface 32, and a roller block central aperture 36. The reform and reprofile apparatus 20 also includes a slider block 40, having a slider block outer annular edge 44, a slider block forward surface, and a slider block central aperture 52. Each of the roller block 24 and the slider block 40 are mounted to a mounting shaft 56 through the roller block central aperture 36 and the slider block central aperture 52. Located on the roller block 24 are a pair of reform rollers 60, having an outer edge 64 and an annular flange 68. Also located on the roller block 24 are two pairs of reprofile rollers 72 which have an outer edge 76. The mounting shaft 56 is interconnected to a motor or other type of energy source to impart a rotating motion to the mounting shaft 56.

Figure 4:
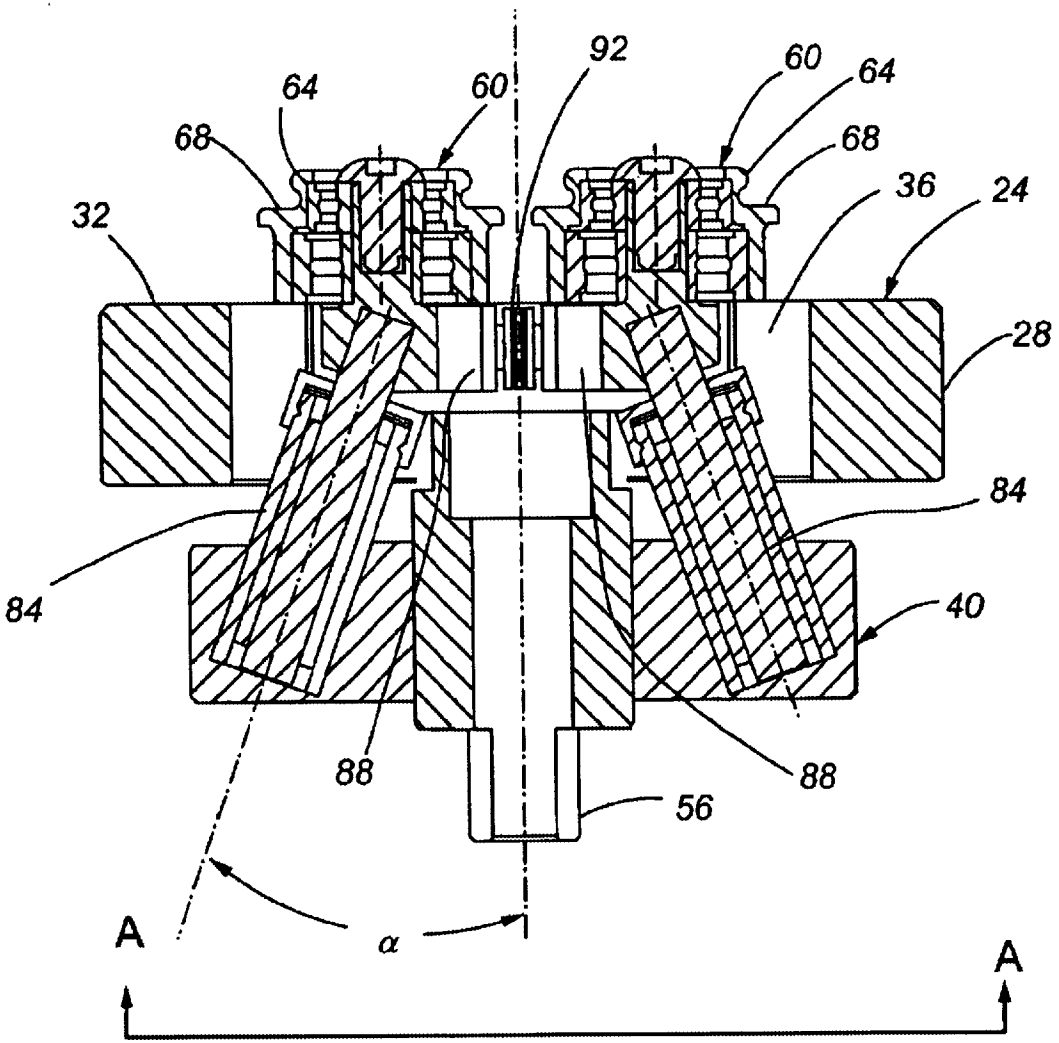
FIG. 4 is a cross-sectional front elevation view of the reform and reprofile apparatus shown in FIG. 2.
Figure 5:
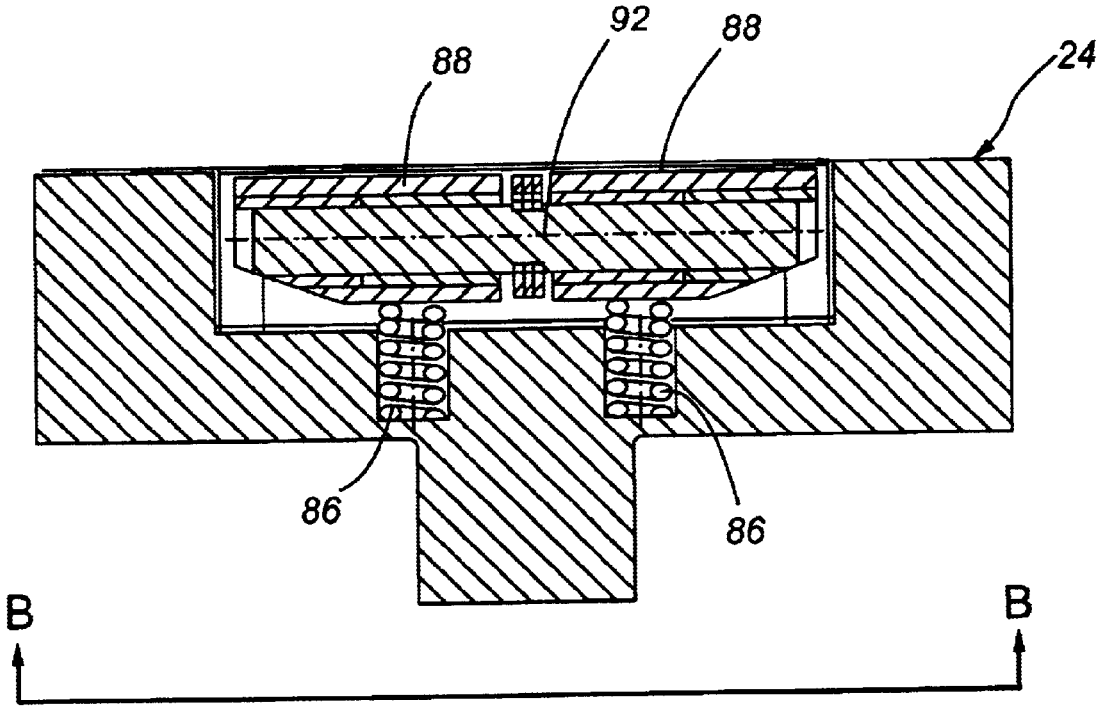
FIG. 5 is a cross-sectional front elevation view of the reform and reprofile apparatus shown in FIG. 2 taken along section B—B.

FIGS. 4-7 are cross-sectional front elevation views of the apparatus of FIGS. 1-3, taken along sections A—A, B—B, C—C, and D—D, respectively. As illustrated in FIG. 4, the reform rollers 60 are mounted to reform roller bushings 84, which extend into the slider block 40. The reform roller bushings 84 extend into the slider block 40 at an angle $\alpha$ with respect to an imaginary plane which extends normally from the roller block leading surface 32 and is centered between the pair of reform rollers 60. In one embodiment, the reform roller bushings 84 are linear ball bushings. Biasing springs 86 (FIG. 5) are included in the roller block central aperture 36, and are interconnected with the pair of reform rollers 60 to bias the reform rollers 60 in a direction away from the slider block 40. When a force is applied to the reform rollers 60, the reform rollers 60 move simultaneously in a direction toward the slider block 40, and also in a direction toward the roller block outer annular edge 28. Each reform roller 60 is interconnected to a link block 88, with the link blocks 88 interconnected with guide pins 92, thus ensuring that both reform rollers 60 move in a coordinated fashion. Although in a preferred embodiment both reform rollers 60 move outwardly in a simultaneous fashion, it is feasible that only one of the reform rollers 60 move at a given time.

Figure 6:
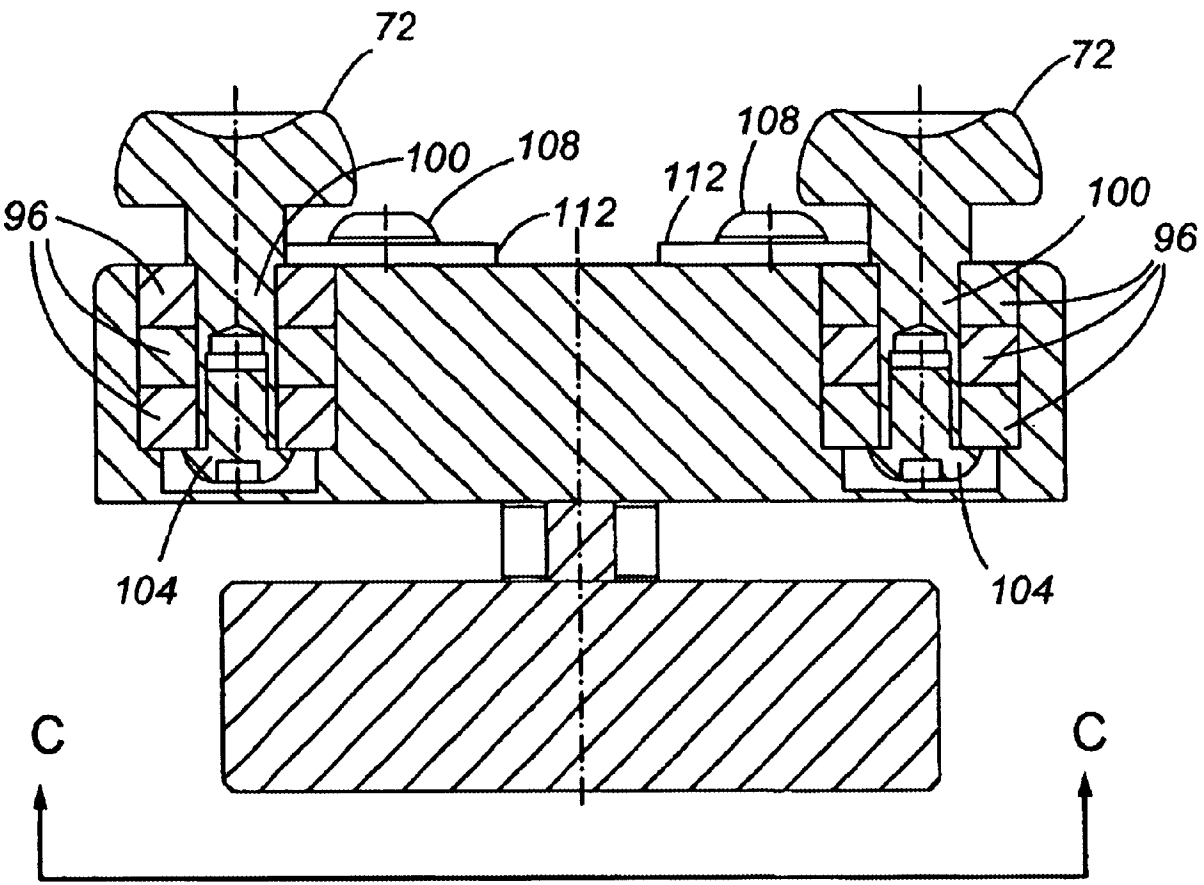
FIG. 6 is a cross-sectional front elevation view of the reform and reprofile apparatus shown in FIG. 2 and taken along section C—C.
Figure 7:
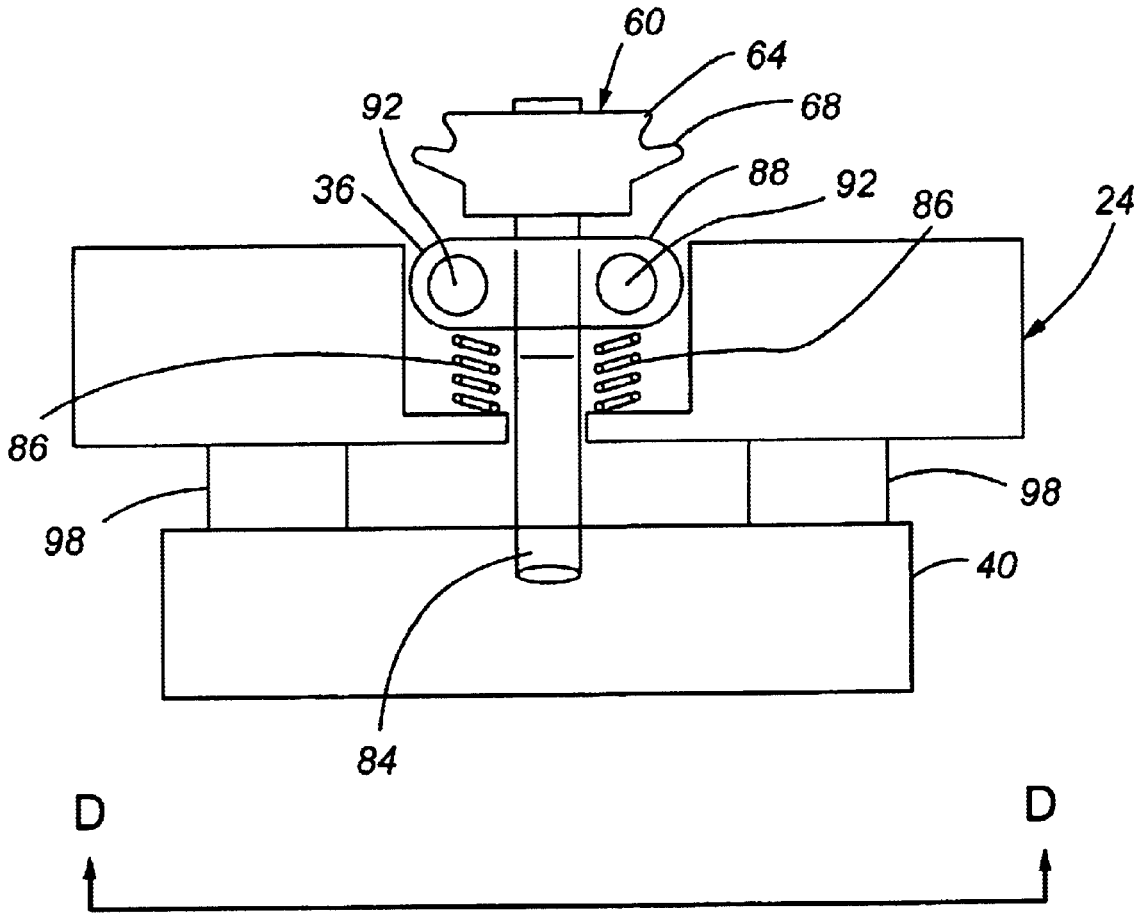
FIG. 7 is a cross-sectional front elevation view of the reform and reprofile apparatus shown in FIG. 2 and taken along section D—D.

The reprofile rollers 72, as illustrated in FIG. 6, include bearing members 96 which allow rotation of a reprofile roller central shaft 100. The bearing members 96 are secured to the reprofile rollers 72 through a screw 104, having a head which overlaps the bearing members 96 and prevents the bearing members 96 from separating from the reprofile roller 72. The assembled reprofile rollers 72, along with the bearing members 96, are inserted into the cavity within the roller block 24 and are secured with a securement screw 108 coupled with a securement washer 112, such that the securement washer 112 overlaps the bearing members 96 to secure the reprofile roller 72 within the cavity. In one embodiment, the securement washers 112 are sized appropriately such that the outer edge of the securement washers 112 do not contact the reprofile roller central shaft 100.

As previously mentioned, the wear of parts is inherent in such a container manufacturing plant based on the tremendous speed and output of product. The reprofile rollers 72, and associated bearing members 96, can be removed and replaced with relative ease by removing the securement screw 108 and securement washer 112 to release the reprofile roller 72 and allow insertion of a replacement roller. In one embodiment, a spring is included within the cavity to provide an upward bias for the reprofile roller 72. In one embodiment, illustrated in FIG. 7, adjustment spacers 96 are located between the roller block 24 and the slider block 40. The adjustment spacers 96 may be sized to provide the proper spacing between the roller block 24 and the slider block 40.

Figure 8:
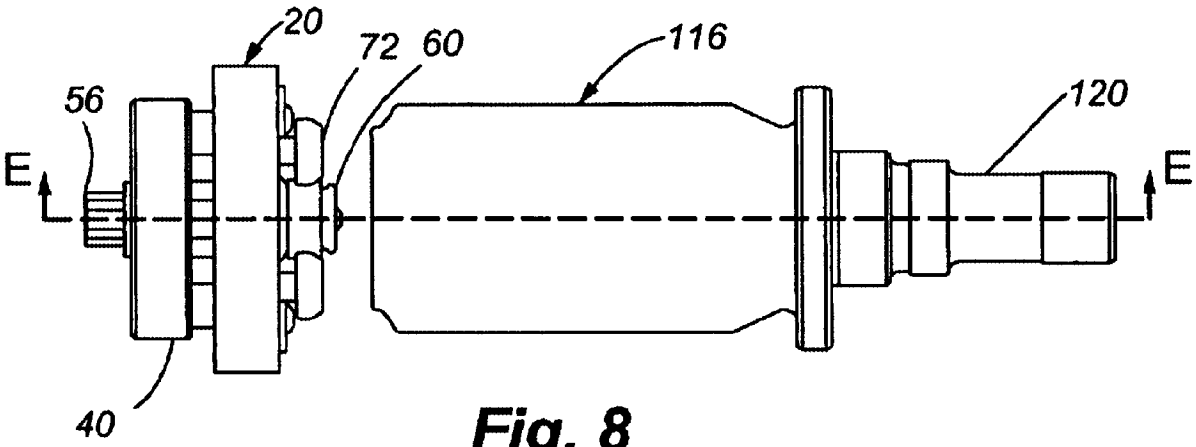
FIG. 8 is a front elevation view of a reform and reprofile system of one embodiment of the present invention and showing a container removably interconnected to a mandrel and in opposing relationship to a reform and reprofile apparatus.
Figure 9:
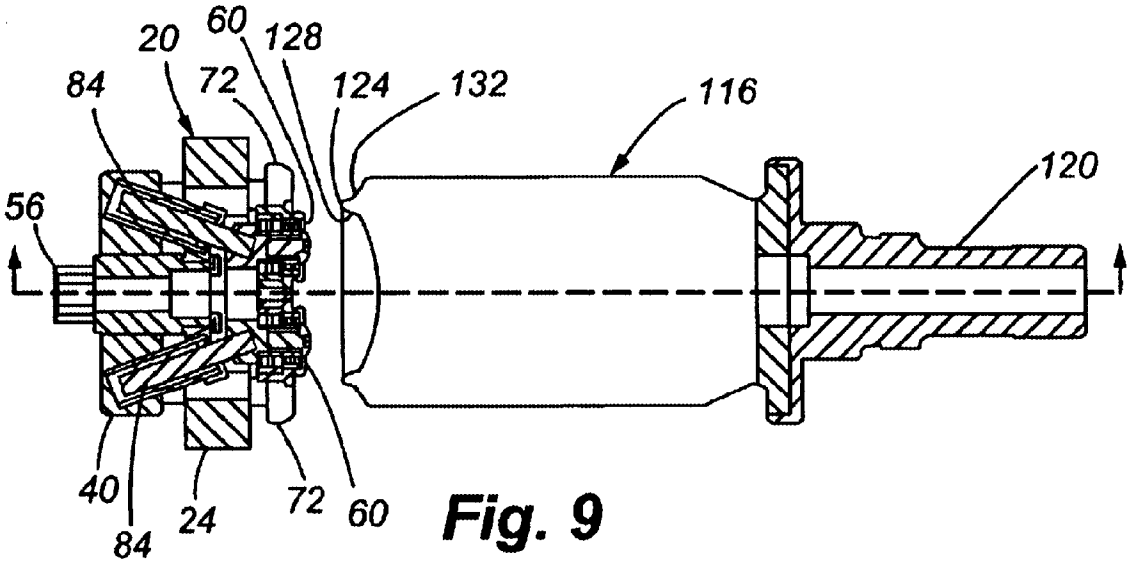
FIG. 9 is a cross-section front elevation view of the reform and reprofile system of FIG. 8 taken along section E—E, and shown just prior to engagement.
Figure 10:
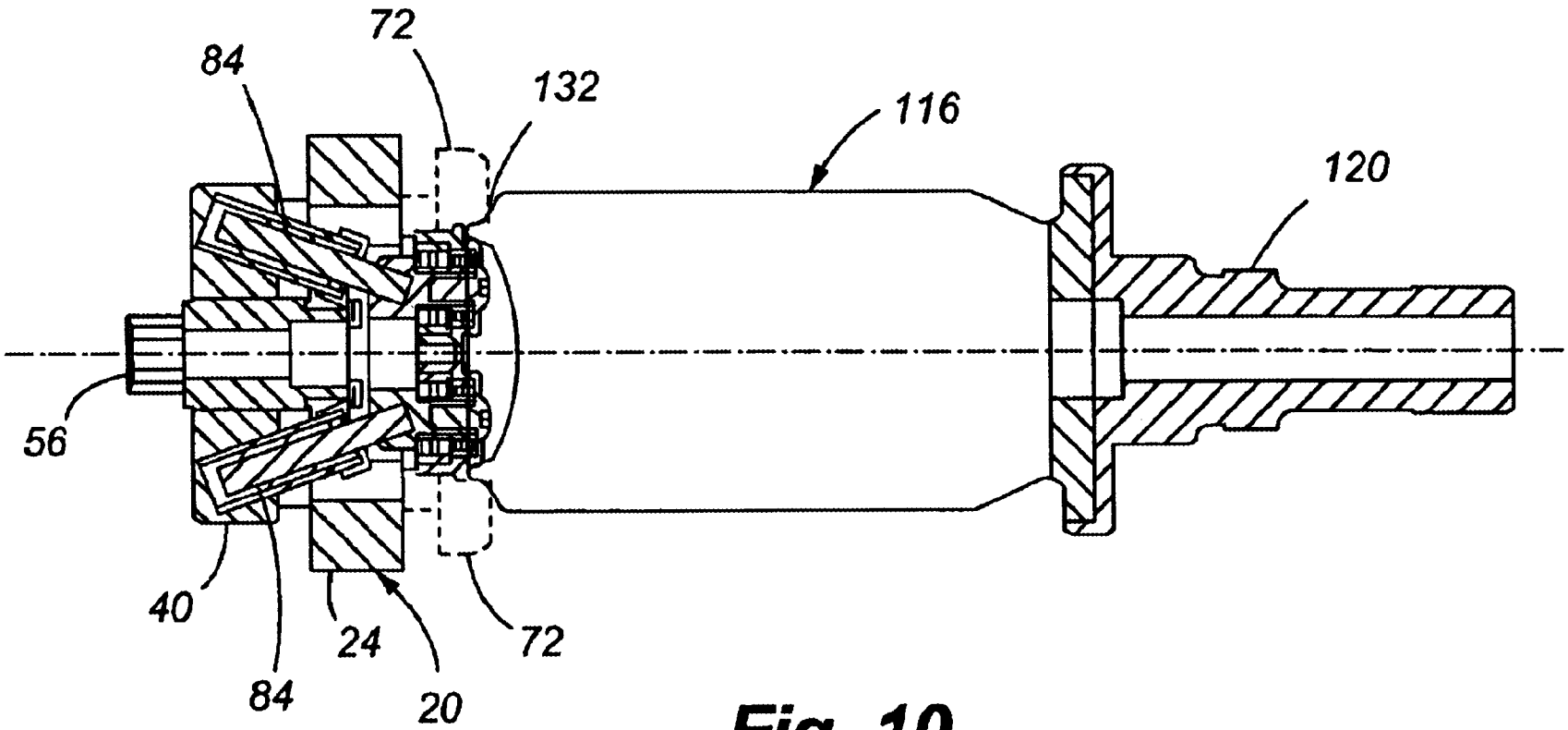
FIG. 10 is a cross-section front elevation view of the reform and reprofile system of FIG. 8 illustrating a beverage container engaged with the reform and reprofile apparatus.

Referring now to FIGS. 8-10, the operation of the reform and reprofile apparatus 20 is now described. FIG. 8 illustrates a front elevation view of the reform and reprofile apparatus 20 and a beverage container 116 mounted to a mandrel 120. FIG. 9 is a cross-sectional front elevation view of the system of FIG. 8 taken along the section E—E. FIG. 10 is a cross-sectional illustration of the system of FIG. 8 with the beverage container 116 engaged with the reform and reprofile apparatus 24. In the embodiment illustrated in FIGS. 8-10, the beverage container 116 is supported by the mandrel 120 in a stationary, non-rotating position. The mandrel 120 and beverage container 116 are moved toward the reforming and reprofiling apparatus 24 until the beverage container 116 makes contact. The bottom portion of the beverage container includes an annular support member 124 with an inner surface 128 and an outer surface 132. The mandrel 120 and beverage container 116 are aligned in such a manner that the annular support member 124 of the beverage container 116 contacts the reform roller annular flange 68. The mandrel 120 and beverage container 116 continue to be moved toward the reform and reprofile apparatus 24, with the annular support member 124 in contact with the reform roller annular flange 68, until the reform rollers 60 are fully engaged with the inner surface 128 of the annular support member 124, and the reprofile rollers 72 are engaged with the outer surface 132, as illustrated in FIG. 10. Similarly, the mandrel 120 and beverage container 116 maybe stationary, with the reprofile apparatus 24 moved toward the beverage container 116, or both the reprofile apparatus 24, and mandrel 120 and beverage container 116, may move towards each other.

As discussed above, applying pressure to the reform roller annular flange 68 results in the reform rollers 60 simultaneously moving in a direction toward the slider block 40 and toward the roller block outer annular edge 28. In one embodiment, once the beverage container 116 is mounted on the mandrel 120, the mandrel 120 is aligned with the reform and reprofile apparatus 20 and moved a preset distance toward the reform and reprofile apparatus 20, resulting in the beverage container 116 being engaged with the reform and reprofile apparatus 20. Once the beverage container 116 is engaged with the reform and reprofile apparatus 20, the reform and reprofile apparatus 20 is rotated. The pressure of the reprofile rollers 72 work to reprofile the outer surface 132 of the annular support member 124, and the pressure of the reform rollers 60 work to reprofile the inner surface 128 of the annular support member 124. Accordingly, the bottom portion of the beverage container 116 is simultaneously reformed and reprofiled to achieve the desired geometric configuration.

Figure 11:
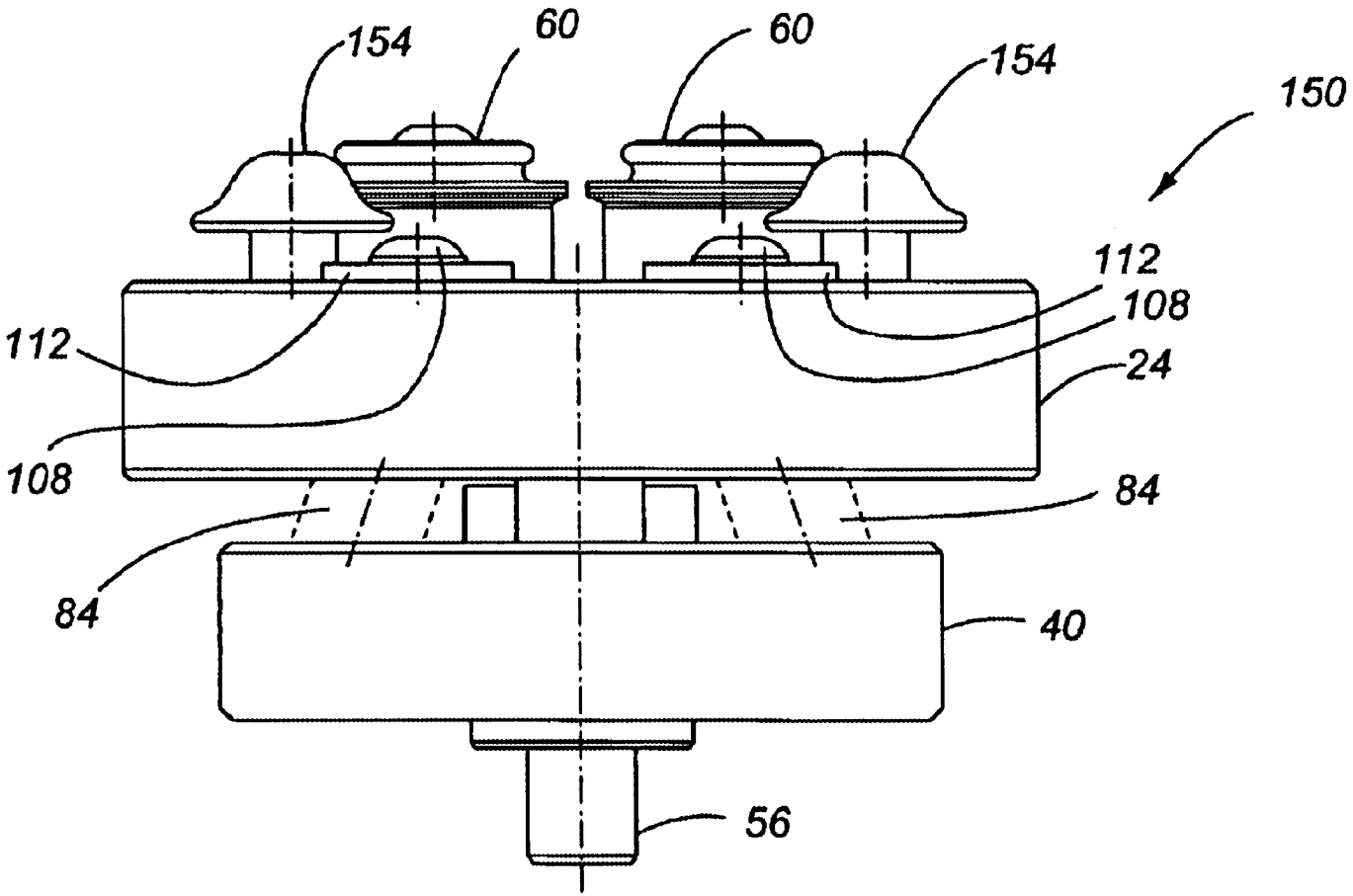
FIG. 11 is a front elevation view of a reform and reprofile apparatus of one embodiment of the present invention.

Referring now to FIG. 11, another embodiment of the present invention is now described. In this embodiment, a reform apparatus 150 is configured to reform the bottom portion of a beverage container only. In this embodiment, the reform apparatus 150 contains components similar to those described above with respect to the reform and reprofile apparatus 20, with one notable difference. The reform apparatus 150 includes reform support rollers 154, rather than reprofile rollers 72. The reform support rollers 154 are operable to provide support for the outside surface of the annular support member of the bottom portion of a beverage container during a reform operation. The reform apparatus 150 operates in a similar fashion as described above with respect to the reform and reprofile apparatus 20, with the reform rollers 60 simultaneously moving in a direction toward the slider block 40, and toward the roller block outer annular edge to apply the appropriate amount fo force to reform the inside surface of the annular support member of a beverage container.

Similarly as described above with respect to FIG. 6, the reform support rollers 154 may be removed from the roller block 24 by removing securement screw 108 and securement washer 112, and removing the reform support roller 154 from a cavity within the roller block 24. In this manner, the same roller block 24 may be used in both reforming and reprofiling operations, as well as in reforming only operations, by simply exchanging reprofile rollers 72 with reform support rollers 154. Such a change may be made when, for example, 204 beverage containers are desired to be produced. If 202 beverage containers are desired to be produced, reprofile rollers 72 may be exchanged for reform support rollers 154. Accordingly, the same base equipment may be used in both processes, resulting in a more efficient manufacturing operation. Furthermore, reforming and reprofiling operations, or reforming operations only, may be performed with no requirement for separate manufacturing equipment.

Figure 12:
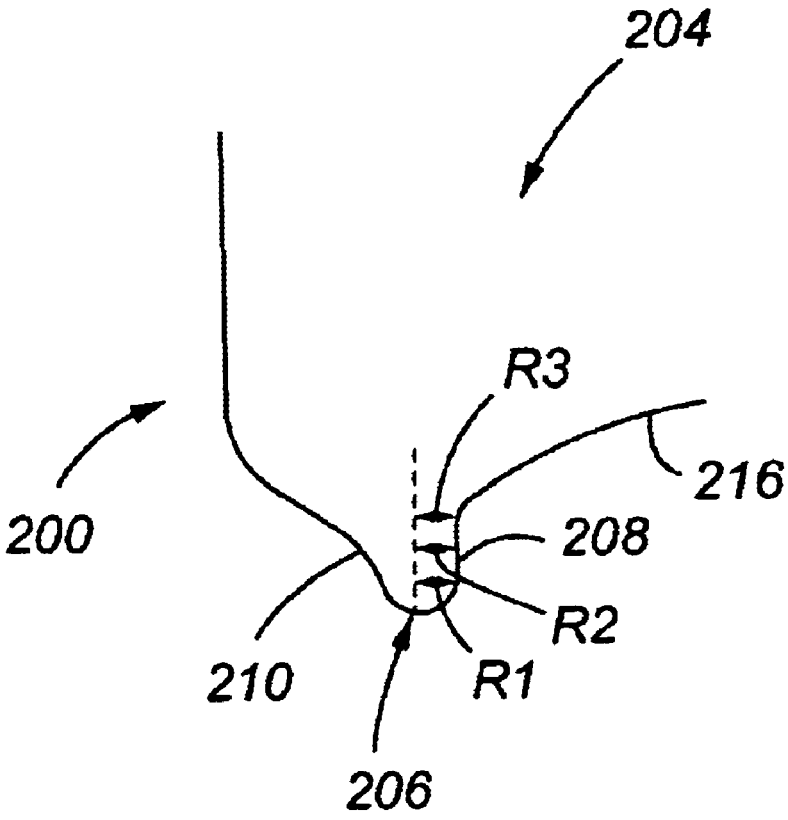
Fig. 12 (Prior Art)
FIG. 12 is a cross-sectional front elevation view of a lower dome portion of a container having no reprofiling or reforming performed.
Figure 13:
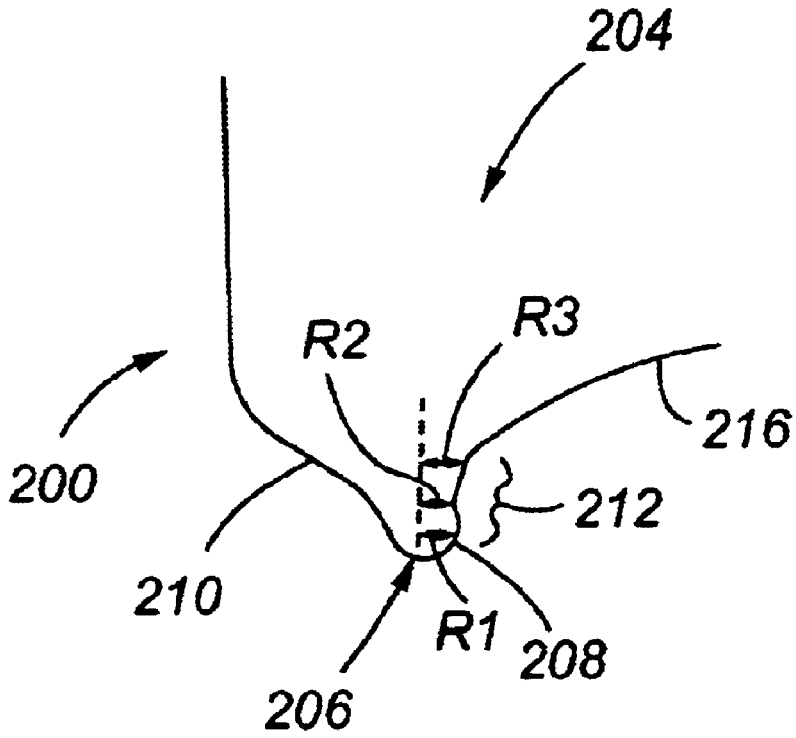
FIG. 13 is a cross-sectional front elevation view of a lower dome portion of a beverage container following a reform operation of one embodiment of the present invention.
Figure 14:
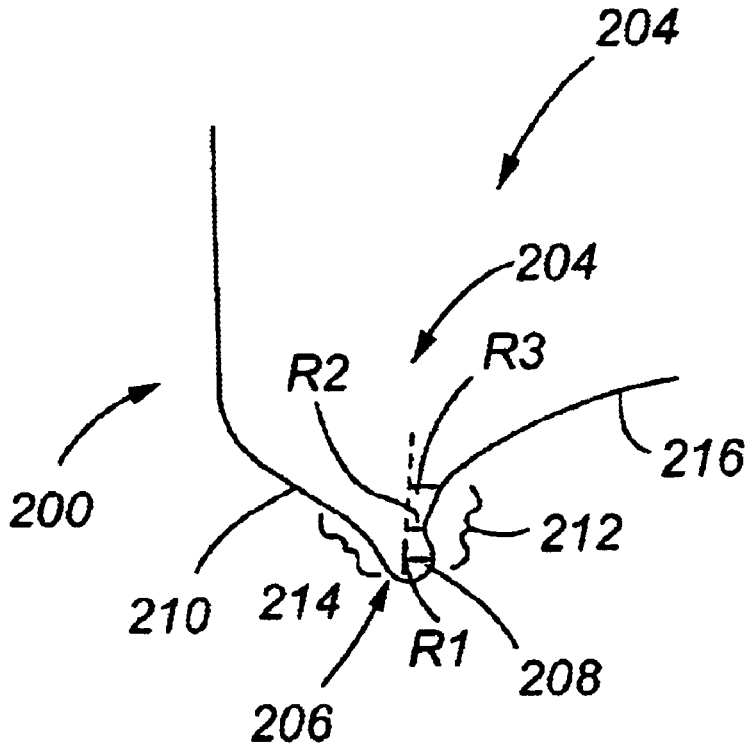
FIG. 14 is a cross-sectional front elevation view of a lower dome portion of a beverage container following a reform and reprofile operation of one embodiment of the present invention.

Referring now to drawing FIGS. 12-14 a cross-section of a lower dome portion of a beverage container 200 showing various geometric configurations for reform and reprofile operations is provided. More specifically, FIG. 12 illustrates a prior art lower dome portion 204 of the beverage container 200, having an annular support member 206 which includes an inner surface 208 and an outer surface 210. Three different radii, R1, R2, and R3 for the annular support member 206 represent the radius of the annular support member 206 with respect to the inner surface 208 at a three different elevations. FIG. 12 illustrates the beverage container 200 in a non-reformed or reprofiled state.

FIG. 13 illustrates the lower dome portion 204 of a beverage container 200 after having been reformed according to one embodiment of the present invention. Following such a reform process, the inner surface 208 of the annular support member 206 includes a portion 212 having a relatively pronounced "hook" shape. The annular support member 206 has a radius R2 which is smaller than either of radii R1 and R3, which defines this hook portion 212. The hook portion 212 helps to enhance the strength characteristics of the lower dome portion 204 of the beverage container 200, and will be described in further detail below.

Referring now to FIG. 14, a lower dome portion 204 of the beverage container 200 is depicted after a reform and reprofile process according to one embodiment of the present invention. As illustrated in FIG. 14, the outer surface 210 of the annular support member 206 includes a reprofile area 214 which further reduces radii R1 and R2 relative to radius R3, and allows a container to be stackable in a 202 configuration. The combination of areas 212 and 214 result in a more pronounced hook shape as a result of the reduction of radii R1 and R2, which further adds to the strength characteristics of the lower dome portion 204 of the beverage container 200.

This preferred geometry illustrated in FIGS. 13 and 14 created by the reform/reprofile operation of the present invention on a beverage container 200 provides superior strength characteristics for the beverage container 200. The superior strength characteristics include increased buckling resistance, due to buckle resisting geometry created when combined forces, as will be described below, alter both the inner and outer surfaces 208, 210 of the annular support member 206. The force exerted while performing reforming and reprofiling operations inhibits outward movement of the dome opening while causing the radii R1, R2, and R3 of the container to be reduced thereby increasing a resistance to roll out and buckle. The strength improvement acquired from the unique hook shape resulting radii R1, R2, and R3 creates a type of locking feature formed into the inner surface 208 of the annular support member.

Further, the "hook" substantially locks the dome wall in place and resists rollout because the hook radius R2 is smaller than either radii R1 and R3. By forming the inner surface 208 in such a manner, the inner surface 208 resists plastic unrolling, or rollout, which may occur when the container 200 is pressurized, and is associated with an increase in one or more of radii R1, R2, and R3. Further, the groove helps prevent unwinding and the resultant increased container length during any pasteurizing process. When pressure is applied to the lower dome portion 204 from inside the container 200, a dome portion 216 is forced toward the bottom portion of the beverage container 200. The geometric shape of the dome portion 216 results in pressure applied to the inner surface 208 in a direction toward the bottom of the container 200 and toward the outer surface 210. When such pressure is applied, as a result of the geometry of the annular support member 206, it is unlikely that any of the radii R1, R2, and R3 will increase, thus reducing the likelihood of rollout and buckle.

For clarity purposes, the following lists of components and the associated numbering in the drawings are provided herein:

| No. | Components |
|---|---|
| 20 | Reforming and reprofiling assembly |
| 24 | Roller block |
| 28 | Roller block outer annular edge |
| 32 | Roller block leading surface |
| 36 | Roller block central aperture |
| 40 | Slider block |
| 44 | Slider block outer annular edge |
| 48 | Slider block forward surface |
| 52 | Slider block central aperture |
| 56 | Mounting shaft |
| 60 | Reform rollers |
| 64 | Reform rollers outer edge |
| 68 | Reform rollers annular flange |
| 72 | Reprofile rollers |
| 76 | Reprofile rollers outer edge |
| 84 | Reform roller bushing |
| 86 | Biasing spring |
| 88 | Link block |
| 92 | Guide pins |
| 96 | Bearings |
| 98 | Adjustable spacers |
| 100 | Reprofile roller central shaft |
| 104 | Screw |
| 108 | Securement screw |
| 112 | Securement washer |
| 116 | Beverage container |
| 120 | Mandrel |
| 124 | Annular support member |
| 128 | Inside surface |
| 132 | Outside surface |
| 150 | Reforming assembly |
| 154 | Reform support roller |
| 200 | Beverage container |
| 204 | Lower dome profile |
| 206 | Annular support member |
| 208 | Inner surface |
| 210 | Outer surface |
| 212 | Hook area |
| 214 | Reprofile area |
| 216 | Dome portion |

The foregoing description of the present invention has been presented for purposes of illustration and description. Furthermore, the description is not intended to limit the invention to the form disclosed herein. Consequently, variations and modifications commenced here with the above teachings and the skill or knowledge of the relevant art are within the scope in the present invention. The embodiments described herein above are further extended to explain best modes known for practicing the invention and to enable others skilled in the art to utilize the invention in such, or other, embodiments or various modifications required by the particular applications or uses of present invention. It is intended that the dependent claims be construed to include all possible embodiments to the extent permitted by the prior art.

What is claimed is:

1. An apparatus adapted for simultaneously reforming and reprofiling a bottom portion of a container, the container having a side wall disposed about a longitudinal axis, the bottom portion being interconnected to the side wall and having an annular support member with an inner surface and an outer surface, comprising:

a means for holding said container, a container reforming assembly comprising a roller block aligned in opposing relationship to the bottom portion of the container, said roller block having an outer annular edge and a leading surface;

a rotating means for rotating said reform assembly;

two pairs of outside reprofile rollers which extend outwardly from said leading surface of said roller block and are positioned proximate to said outer annular edge;

a pair of reform rollers which project outwardly from said roller block leading surface and which are operably sized to receive the inner surface of the annular support member of the container; and a biasing means operably interconnected to said pair of reform rollers, wherein when a force is applied to an annular flange on said pair of reform rollers by the bottom portion of the container, said reform rollers extend outwardly toward said outer annular edge of said roller block, wherein an interior can profile is created on the inner surface of said annular support member by said pair of reform rollers, and an exterior can profile is created on the outer surface of said annular support member by said two pairs of outside reprofile rollers.

2. The apparatus of claim 1, wherein each of said reform rollers extend outwardly at least about 0.10 inches when the force is applied to said flanges on said pair of reform rollers.

3. The apparatus of claim 1, wherein each of said pair of reform rollers are operably interconnected to a bushing which is oriented transversely to said longitudinal axis of said container.

4. The apparatus of claim 1, wherein said means for holding said container comprises a mandrel operably sized to engage an interior surface of the side walls of the container.

5. The apparatus of claim 1, wherein said biasing means comprises at least one spring which is operably interconnected to at least one of said pair of reform rollers.

6. The apparatus of claim 1, wherein at least one of said pair of reform rollers move in at least two distinct directions when said force is applied to said flange on said pair of reform rollers.

7. The apparatus of claim 1, wherein said container reforming assembly further comprises a slider block which is operably positioned between said roller block and a mounting shaft.

8. The apparatus of claim 1, wherein said reprofile rollers can be selectively removed and said reform rollers can be used in conjunction with outside support rollers to reform the inner surface of said annular support member.

9. The apparatus of claim 1, wherein said rotating means comprises a shaft operably interconnected to motor.

10. The apparatus of claim 1, wherein said means for holding said container supports said container in a non-rotating, substantially stationary position.

11. An apparatus adapted for reforming a bottom portion of a container, said container having an outer wall disposed around a longitudinal axis, comprising:

a mandrel operably supporting said container in a substantially stationary position;

a reforming assembly comprising:

a main roller block;

at least two reform rollers and at least two reprofile rollers extending outwardly from said main roller block in a direction substantially parallel to said longitudinal axis of said container and positioned in opposing alignment to the bottom portion of said container;

a rotating means operably interconnected to said reforming assembly to rotate said reforming assembly around said longitudinal axis of said container; and a biasing means operably interconnected to said at least two reform rollers, wherein when a downward pressure is applied to an annular flange of said at least two reform rollers, at least one of said at least two reform rollers moves in an outward direction toward an annular edge of said main roller block to engage an inner surface of an annular bottom portion of the container, wherein a preferred geometric profile of said container bottom portion is formed.

12. The apparatus of claim 11, wherein said at least two reprofile rollers additionally form a preferred geometric profile of an outer surface of said annular bottom portion of the container.

13. The apparatus of claim 11, wherein each of said pair of reform rollers are operably interconnected to a bushing which is oriented transversely to said longitudinal axis of said container.

14. The apparatus of claim 11, wherein said biasing means comprises a spring.

15. The apparatus of claim 11, wherein said main roller block is operably interconnected to an adjustable slider block and a mounting shaft.

16. A method for simultaneously reforming and reprofiling a bottom portion of a metallic container, comprising the steps of:

holding the container in a substantially stationary position, said container having side walls disposed about a substantially longitudinal axis;

providing a reforming assembly, comprising:

a roller block having an outer annular edge and a leading surface, said leading surface aligned in opposing relationship to the bottom portion of said metallic container;

at least one pair of outside reprofile rollers which extend outwardly from said leading surface of said roller block;

a pair of reform rollers which project outwardly from said roller block leading surface and which include a flange sized to engage an annular support member on the bottom portion of the container;

a biasing means in operable engagement with said pair of reform rollers, wherein when a force is applied to said flange, at least one of said pair of reform rollers moves outwardly toward said annular edge; and rotating said reforming assembly around said substantially longitudinal axis; and engaging the annular support member of the metallic container with said pair of reform rollers, wherein an inner surface of said annular support member is reformed to a preferred geometry and an outer surface of said annular support member is reprofiled to a preferred geometry at substantially the same time.

17. The method of claim 16, wherein said reform rollers move outwardly at least about 0.100 inches when said force is applied to said flange.

18. The method of claim 16, wherein said rotating said reforming assembly step comprises rotating said reforming assembly with a motor.

19. The method of claim 16, wherein said holding the container step comprises a support means which engages at least a portion of an internal surface of the side walls of the container.

20. The method of claim 16, wherein said reforming assembly further comprises an adjustable slider block operably positioned below said roller block.

21. The method of claim 16, wherein said pair of reform rollers are operably interconnected to a bushing which is oriented transversely to said longitudinal axis of said container.

22. The method of claim 16, wherein at least one of said pair of reform rollers moves in two distinct directions when a force is applied to said flange in a direction toward said leading surface.

23. An apparatus adapted for reforming an end portion of a container, said container having an outer wall disposed around a longitudinal axis, comprising:

a mandrel operably supporting said container in a substantially stationary position;

a reforming assembly comprising:

a main roller block;

at least two reform rollers and at least two reprofile rollers extending outwardly from said main roller block in a direction substantially parallel to said longitudinal axis of said container and positioned in opposing alignment to the bottom portion of said container;

a rotating means operably interconnected to said reforming assembly to rotate said reforming assembly around said longitudinal axis of said container; and a biasing means operably interconnected to said at least two reform rollers, wherein when a downward pressure is applied to an annular flange of said at least two reform rollers, at least one of said at least two reform rollers moves in an outward direction toward an annular edge of said main roller block to engage an inner surface of an annular bottom portion of the container, wherein a preferred geometric profile of said container bottom portion is formed.

24. The apparatus of claim 23, wherein each of said reform rollers extend outwardly at least about 0.10 inches when said force is applied to said flanges on said pair of reform rollers.

25. The apparatus of claim 23, wherein each of said pair of reform rollers are operably interconnected to a bushing which is oriented transversely to said longitudinal axis of said container.

26. The apparatus of claim 23, wherein said biasing means comprises at least one spring operably interconnected to at least one of said pair of reform rollers.

27. The apparatus of claim 23, wherein said pair of reform rollers move in at least two distinct directions when said force is applied to said flange on said pair of reform rollers.

28. The apparatus of claim 23, wherein said container reforming assembly further comprises a slider block which is operably interconnected to a lower portion of said roller block and a mounting shaft.

29. The apparatus of claim 23, wherein said reprofile rollers can be selectively removed and outside support rollers replaced therefor, and said reform rollers can be used to reform only the inner surface of said annular support member.

30. The apparatus of claim 23, wherein said rotating means comprises a shaft operably interconnected to a motor.

31. The apparatus of claim 23, wherein said at least two reprofile rollers engage an outer surface of the annular bottom portion of the container, wherein the container bottom is reformed and reprofiled substantially simultaneously.

* * * * *

UNITED STATES PATENT AND TRADEMARK OFFICE
Certificate

Patent No. 6,837,089 B2 Patented: January 4, 2005

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Kevin Reed Jentzsch, Arvada, CO (US); and Mark A. Jacober, Arvada, CO (US).

Signed and Sealed this Twentieth Day of November 2007.

DERRIS H. BANKS
*Supervisory Patent Examiner*
Art Unit 3725

UNITED STATES PATENT AND TRADEMARK OFFICE
Certificate

Patent No. 6,837,089 B2 Patented: January 4, 2005

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Parag Thakre, Bhilai (IN); Shankar Chandrasekaran, Chennai (IN); Kuna Venkat Satya Rama Kishore, Bangalore (IN); Russell William Craddock, Nuneaton (GB); Kanakasabapathi Subramanian, Clifton Park, NY (US).

Signed and Sealed this Twenty-seventh Day of November 2007.

HEZRON WILLIAMS
*Supervisory Patent Examiner*
Art Unit 2856

UNITED STATES PATENT AND TRADEMARK OFFICE
Certificate

Patent No. 6,837,089 B2 Patented: January 4, 2005

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Kevin Reed Jentzsch, Arvada, CO (US); and Mark A. Jacober, Arvada, CO (US).

Signed and Sealed this Twenty-fifth Day of December 2007.

DERRIS H. BANKS
*Supervisory Patent Examiner*
Art Unit 3725